US011284650B2

(12) United States Patent
Cordova

(10) Patent No.: US 11,284,650 B2
(45) Date of Patent: Mar. 29, 2022

(54) PORTABLE CHANGING ROOM ASSEMBLY

(71) Applicant: Martin Cordova, Maywood, CA (US)

(72) Inventor: Martin Cordova, Maywood, CA (US)

( * ) Notice: Subject to any disclaimer, the term of this patent is extended or adjusted under 35 U.S.C. 154(b) by 915 days.

(21) Appl. No.: 15/856,968

(22) Filed: Dec. 28, 2017

(65) Prior Publication Data

US 2019/0200687 A1 Jul. 4, 2019

(51) Int. Cl.

| | |
|---|---|
| ***A41D 7/00*** | (2006.01) |
| ***A41D 3/08*** | (2006.01) |
| ***A41D 27/20*** | (2006.01) |

(52) U.S. Cl.

CPC ..... *A41D 3/08* (2013.01); *A41D 7/008* (2013.01); *A41D 27/20* (2013.01); *A41D 2400/422* (2013.01)

(58) Field of Classification Search

CPC ..... E04H 15/30; E04H 15/003; A45F 4/12; A45C 3/001; A41D 13/08; A41D 7/008; A41D 2400/422; A41D 3/005; A41D 3/02

USPC ..... 2/69, 69.5, 86, 88

See application file for complete search history.

(56) References Cited

U.S. PATENT DOCUMENTS

| | | | | |
|---|---|---|---|---|
| 1,599,798 | A * | 9/1926 | Stockton | E04H 1/1244 135/115 |
| 2,376,284 | A * | 5/1945 | Sidelmann | E04H 15/003 2/89 |
| 3,132,344 | A * | 5/1964 | Langdon | G21F 3/025 2/1 |
| 3,288,157 | A * | 11/1966 | Szkolny | A45F 4/04 135/95 |
| 8,943,614 | B2 | 2/2015 | Salinas | |
| 8,990,967 | B2 * | 3/2015 | Tallon | E04H 15/30 2/89 |
| D747,593 | S | 1/2016 | Caco | |
| 9,932,752 | B1 * | 4/2018 | Vila | A45F 3/02 |
| 2002/0170104 | A1 | 11/2002 | Kalina | |
| 2006/0143773 | A1 * | 7/2006 | Danilova | A41D 7/008 2/88 |
| 2007/0061940 | A1 | 3/2007 | Cazares | |
| 2015/0184378 | A1 * | 7/2015 | Silva | E04H 15/003 160/351 |

* cited by examiner

*Primary Examiner* — Katherine M Moran

(57) ABSTRACT

A portable changing room assembly for discretely disrobing in a public location includes a shroud that may be worn around the neck of a user. The shroud has a length of at least 5.0 feet such that the shroud extends from the users neck to the ground. The shroud is comprised of an opaque material to inhibit the user from being visible through the shroud. In this way the user may disrobe behind the shroud in a public area. The shroud has a pass-through extending through the shroud and an object passed through the pass-through to be employed by the user. A pocket is coupled to the shroud and the shroud is selectively gathered into the pocket for storage.

8 Claims, 7 Drawing Sheets

PORTABLE CHANGING ROOM ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to portable room devices and more particularly pertains to a new portable room device for discretely disrobing in a public location.

BRIEF SUMMARY OF THE INVENTION

An embodiment of the disclosure meets the needs presented above by generally comprising a shroud that may be worn around the neck of a user. The shroud has a length of at least 5.0 feet such that the shroud extends from the users neck to the ground. The shroud is comprised of an opaque material to inhibit the user from being visible through the shroud. In this way the user may disrobe behind the shroud in a public area. The shroud has a pass-through extending through the shroud and an object passed through the pass-through to be employed by the user. A pocket is coupled to the shroud and the shroud is selectively gathered into the pocket for storage.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
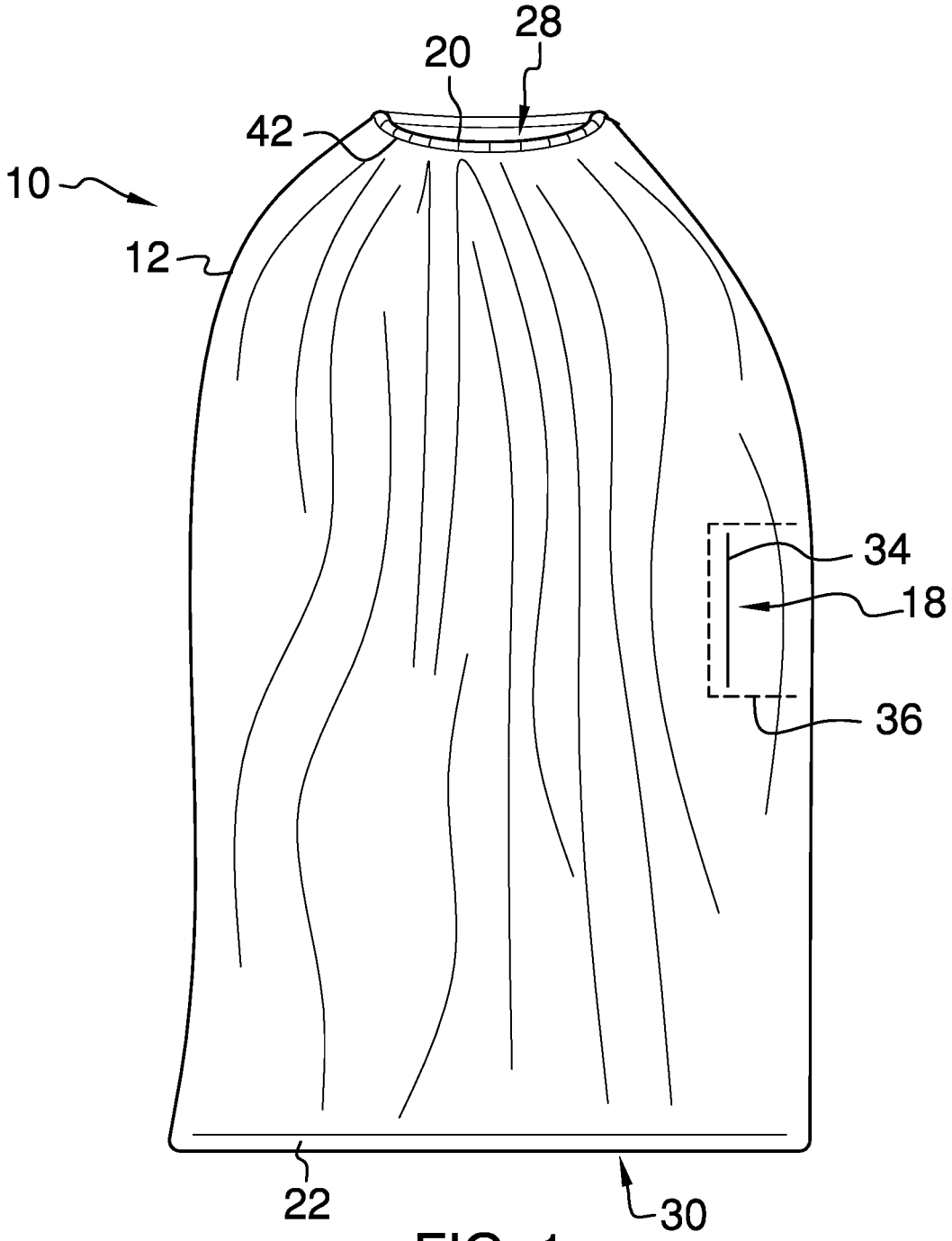
FIG. 1 is a front view of a portable changing room assembly according to an embodiment of the disclosure.
Figure 2:
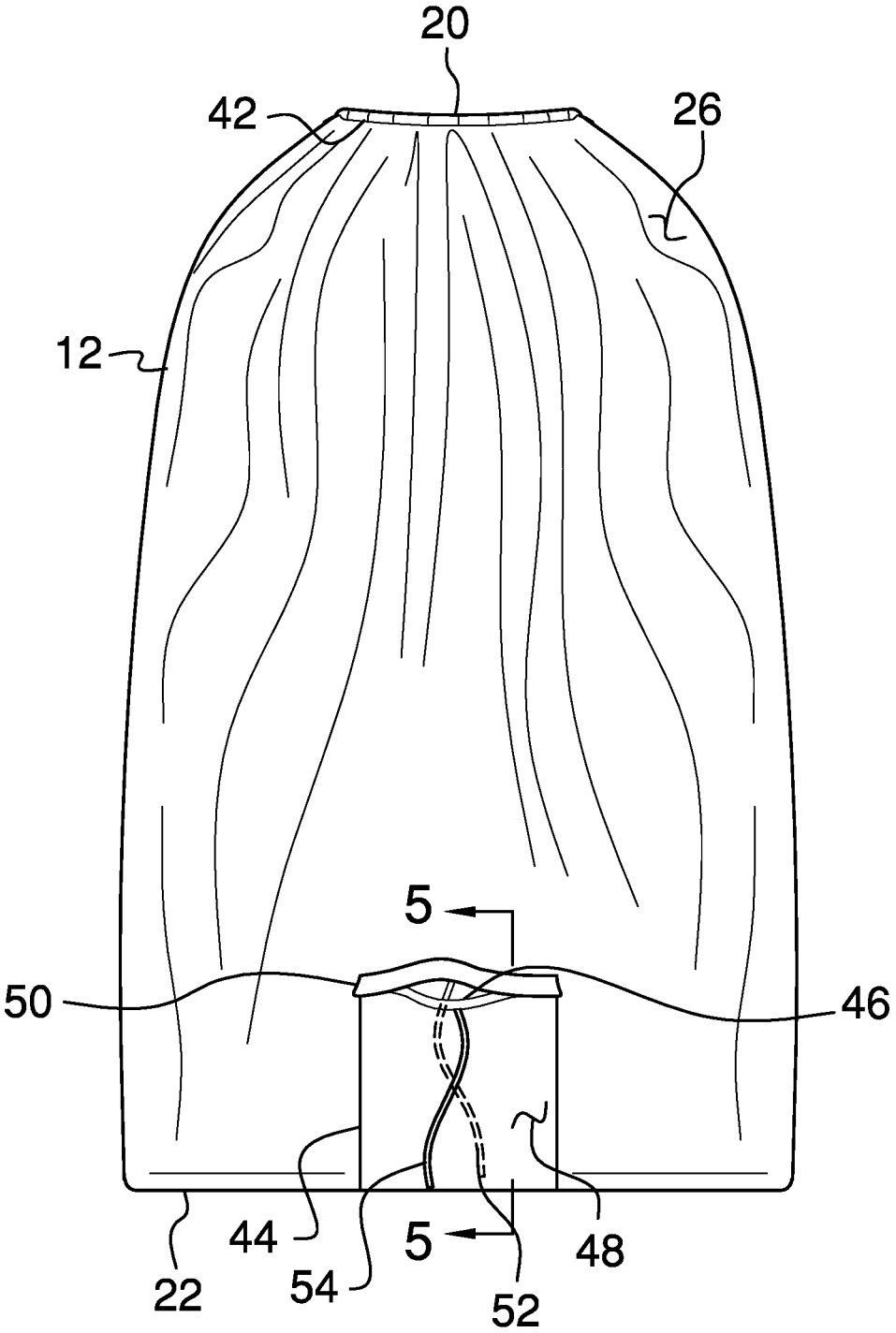
FIG. 2 is a back view of an embodiment of the disclosure.
Figure 3:
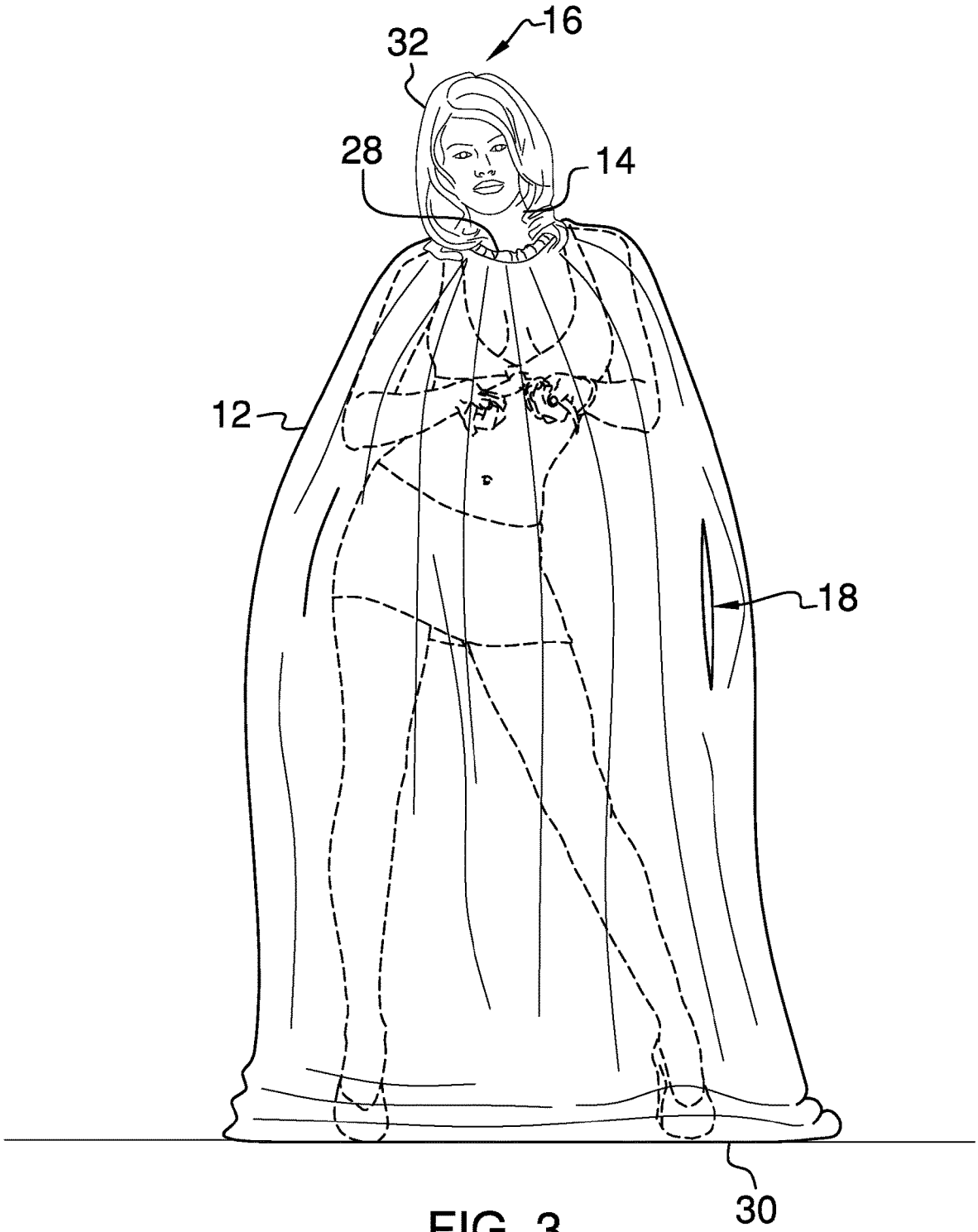
FIG. 3 is a phantom in-use view of an embodiment of the disclosure.
Figure 4:
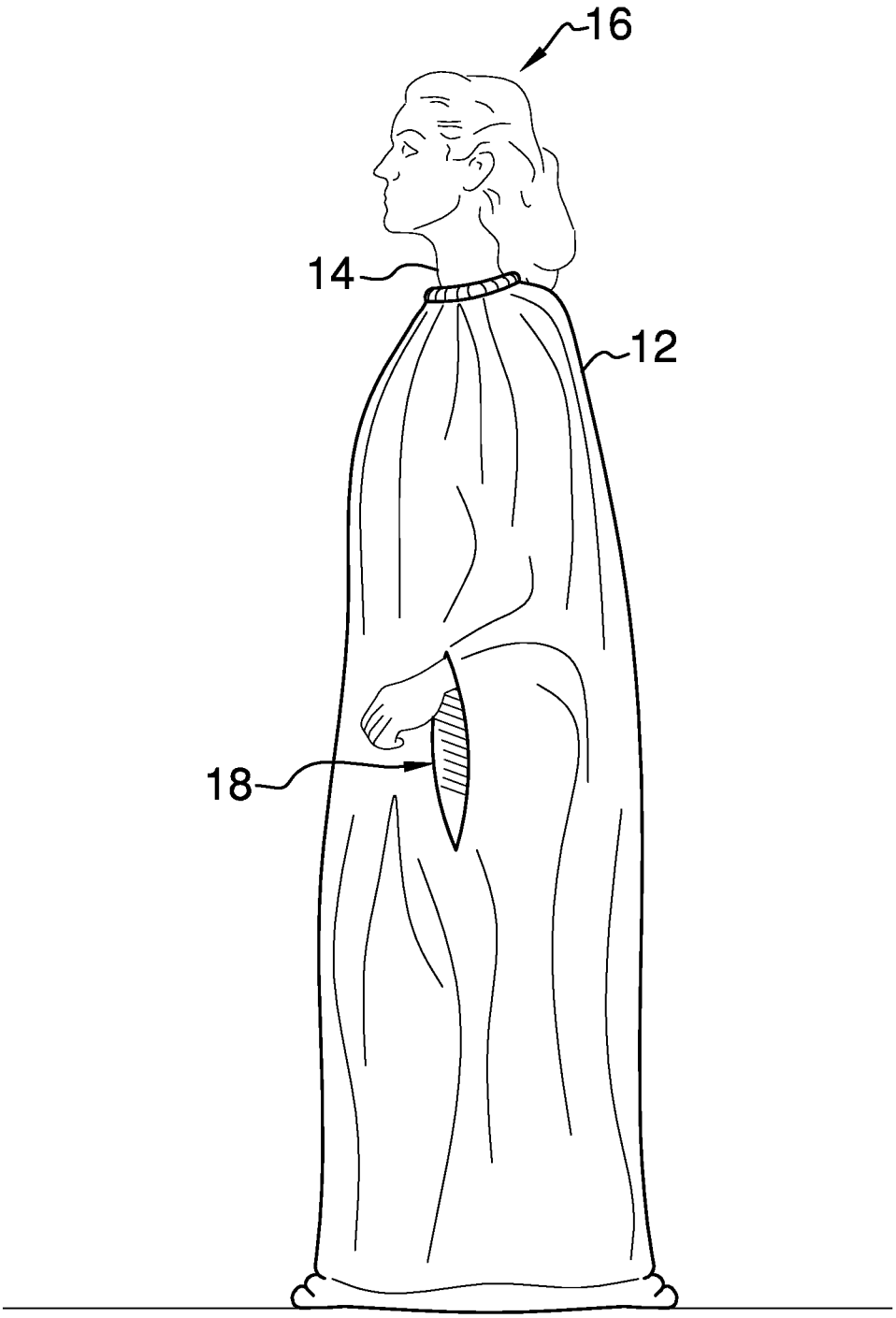
FIG. 4 is a perspective in-use view of an embodiment of the disclosure.
Figure 5:
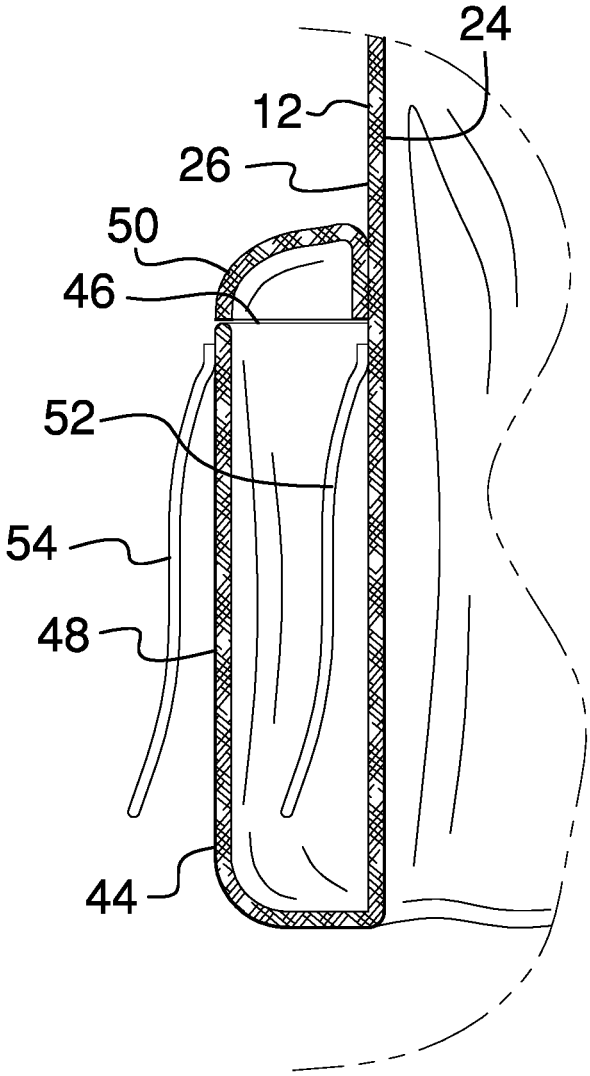
FIG. 5 is a cross sectional view taken along line 5-5 of FIG. 2 of an embodiment of the disclosure.
Figure 6:
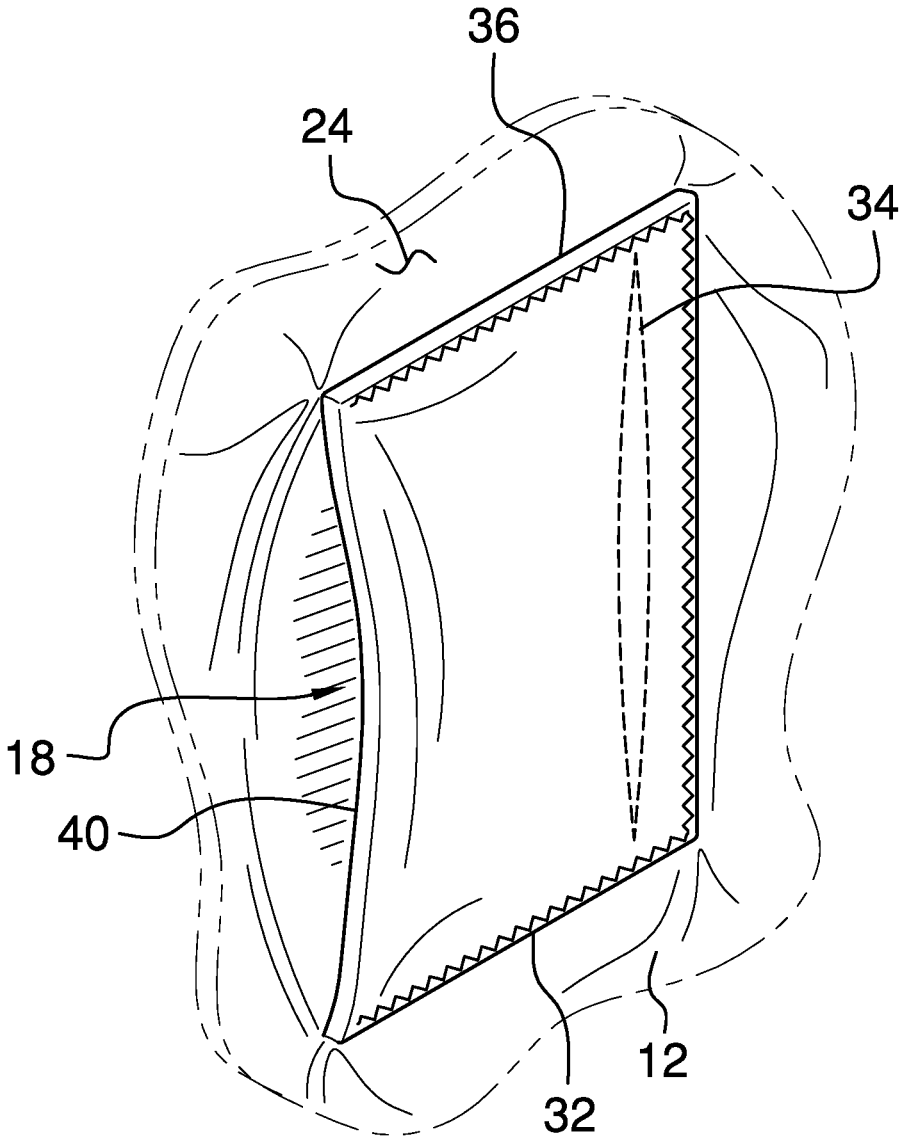
FIG. 6 is a perspective view of a pass-through of an embodiment of the disclosure.
Figure 7:
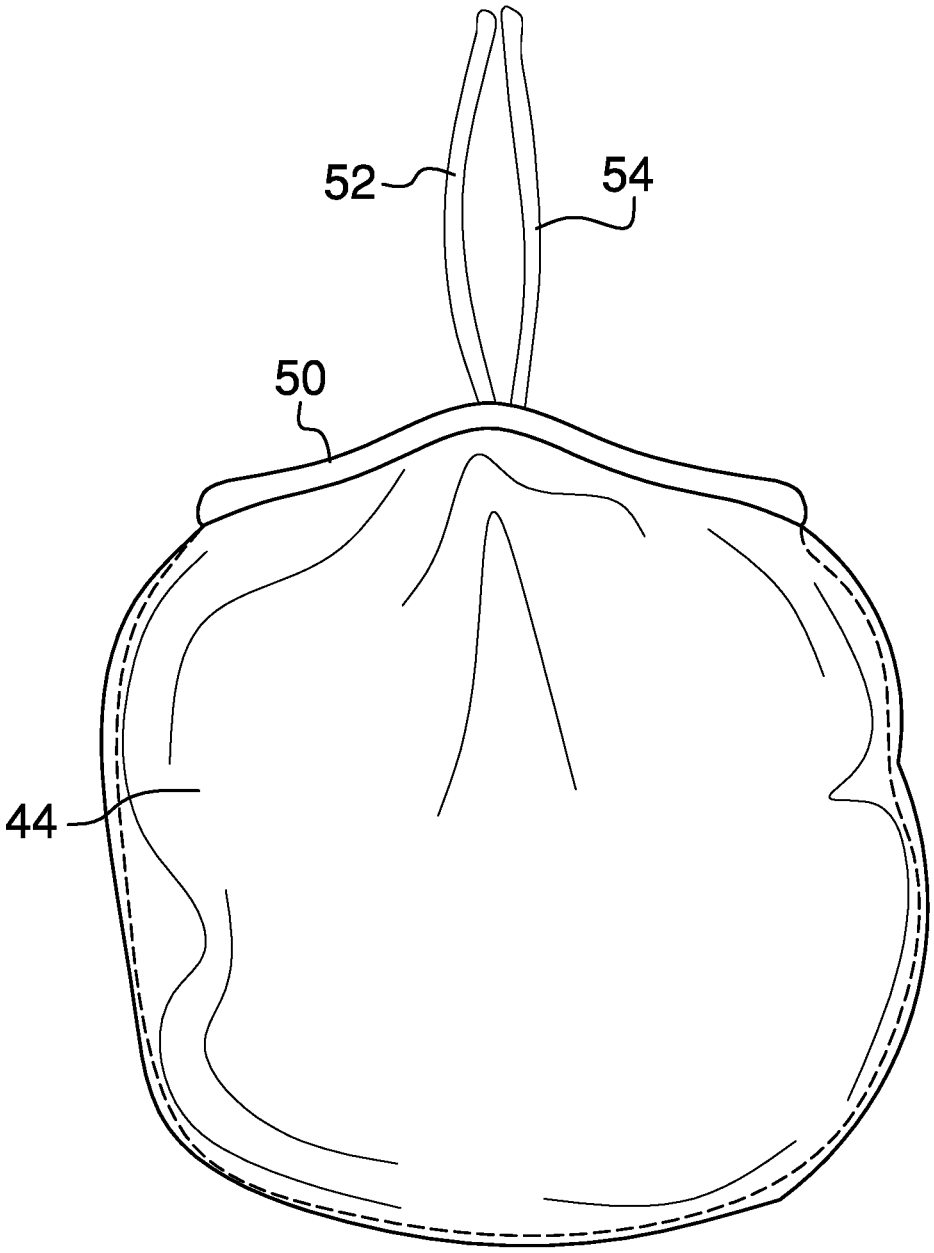
FIG. 7 is a perspective view showing a shroud being stored in a pocket.

With reference now to the drawings, and in particular to FIGS. 1 through 7 thereof, a new portable room device embodying the principles and concepts of an embodiment of the disclosure and generally designated by the reference numeral 10 will be described.

As best illustrated in FIGS. 1 through 7, the portable changing room assembly 10 generally comprises a shroud 12 that is selectively worn around the neck 14 of a user 16. The shroud 12 has a length of at least 5.0 feet such that the shroud 12 extends from the user's 16 neck 14 to the ground. The shroud 12 is comprised of an opaque material to inhibit the user 16 from being visible through the shroud 12. In this way the shroud 12 facilitates the user 16 to disrobe behind the shroud 12 in a public area. The shroud 12 has a pass-through 18 extending through the shroud 12 and an object may be passed therethrough to be employed by the user 16. The object may be clothing to be worn by the user 16 when the user 16 disrobes.

The shroud 12 has a top edge 20, a bottom edge 22, an inside surface 24 and an outside surface 26. Each of the top edge 20 and the bottom edge 22 is continuous such that the shroud 12 defines a cylindrical shape. Moreover, the top edge 20 defines a top opening 28 and the bottom edge 22 defines a bottom opening 30 in the cylindrical shape. The user 16's head 32 is extended through the top opening 28 such that the top edge 20 surrounds the user 16's neck 14 and the bottom edge 22 is positioned on the ground. The shroud 12 has a cut 34 extending through the inside surface 24 and the outside surface 26 and an object is extended through the cut 34.

A panel 36 is coupled to the shroud 12 and the panel 36 is aligned with the cut 34 such that the cut 34 and the panel 36 define the pass-through 18. The panel 36 inhibits the user 16 from being visible through the cut 34 to enhance the user 16's privacy. The panel 36 has a peripheral edge 38 and the peripheral edge 38 has a first side 40. The peripheral edge 38 is attached to the inside surface 24 of the shroud 12 and the first side 40 of the panel 36 is unattached from the shroud 12. Moreover, the first side 40 is spaced from the cut 34 such that the panel 36 defines the pass-through 18 extending between the cut 34 and the first side 40.

An elastic member 42 is coupled to the shroud 12 and the elastic member 42 is aligned with and is coextensive with the top edge 20 of the shroud 12. The elastic member 42 biases the top edge 20 to engage the user 16's neck 14 thereby retaining the shroud 12 on the user 16. A pocket 44 is coupled to the shroud 12 and the shroud 12 is selectively gathered into the pocket 44 for storage. The pocket 44 is positioned on the outside surface 26 of the shroud 12 and the pocket 44 has a top end 46. The top end 46 is open such that the shroud 12 is selectively pushed through the top end 46 for storage and the pocket 44 has an outwardly facing surface 48 with respect to the shroud 12.

A flap 50 is coupled to the outside surface 26 of the shroud 12 and the flap 50 extends downwardly over the top end 46 of the pocket 44 to cover the top end 46. A first string 52 is coupled to the outside surface 26 of the shroud 12 and the first string 52 is positioned in the pocket 44. A second string 54 is coupled the outwardly facing surface 48 of the pocket 44. The first string 52 is selectively tied to the second string 54 when the shroud 12 is positioned in the pocket 44 thereby retaining the shroud 12 in the pocket 44.

In use, the shroud 12 is worn when the user 16 needs to disrobe in a public location and whenever the user 16 needs privacy in the public location. The object, such as clothing or the like, is passed through the pass-through 18 to transfer to object to the user 16. The panel 36 inhibits the user 16 from being visible when the object is transferred to the user 16. The shroud 12 is bunched up onto itself and the shroud 12 is positioned in the pocked for storage. The first string 52 is tied to the second string 54 to close the pocket 44 and retain the shroud 12 in the pocket 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable changing room assembly being configured to be worn thereby facilitating a user to discreetly disrobe, said assembly comprising:

a shroud being configured to be worn around the neck of a user, said shroud having a length of at least 5.0 feet wherein said shroud is configured to extend from the users neck to the ground, said shroud being comprised of an opaque material wherein said shroud is configured to inhibit the user from being visible through said shroud thereby facilitating the user to disrobe behind said shroud in a public area, said shroud having a pass-through extending through said shroud wherein said pass-through is configured to have an object passed therethrough to be employed by the user, said shroud having a top edge, a bottom edge, an inside surface and an outside surface, each of said top edge and said bottom edge being continuous such that said shroud defines a cylindrical shape having said top edge defining a top opening and having said bottom edge defining a bottom opening in said cylindrical shape, said top opening being configured to have the users head extended therethrough such that said top edge surrounds the users neck having said bottom edge being positioned on the ground; and a pocket being coupled to said shroud, said shroud being selectively gathered into said pocket for storage, said pocket being positioned on said outside surface of said shroud, said pocket having a top end, said top end being open such that said shroud is selectively pushed through said top end for storage, said pocket having an outwardly facing surface with respect to said shroud.

2. The assembly according to claim 1, wherein said shroud has a cut extending through said inside surface and said outside surface wherein said cut is configured to have an object extended therethrough.

3. The assembly according to claim 2, further comprising a panel being coupled to said shroud, said panel being aligned with said cut such that said cut and said panel define said pass-through, said panel being configured to inhibit the user from being visible through said cut.

4. The assembly according to claim 1, further comprising an elastic member being coupled to said shroud, said elastic member being aligned with and being coextensive with said top edge of said shroud wherein said elastic member is configured to bias said top edge to engage the users neck thereby retaining said shroud on the user.

5. The assembly according to claim 1, further comprising a flap being coupled to said outside surface of said shroud, said flap extending downwardly over said top end of said pocket to cover said top end.

6. The assembly according to claim 1, further comprising a first string being coupled to said outside surface of said shroud, said first string being positioned in said pocket.

7. The assembly according to claim 6, further comprising a second string being coupled said outwardly facing surface of said pocket, said first string being selectively tied to said second string when said shroud is positioned in said pocket thereby retaining said shroud in said pocket.

8. A portable changing room assembly being configured to be worn thereby facilitating a user to discreetly disrobe, said assembly comprising:

a shroud being configured to be worn around the neck of a user, said shroud having a length of at least 5.0 feet wherein said shroud is configured to extend from the users neck to the ground, said shroud being comprised of an opaque material wherein said shroud is configured to inhibit the user from being visible through said shroud thereby facilitating the user to disrobe behind said shroud in a public area, said shroud having a pass-through extending through said shroud wherein said pass-through is configured to have an object passed therethrough to be employed by the user, said shroud having a top edge, a bottom edge, an inside surface and an outside surface, each of said top edge and said bottom edge being continuous such that said shroud defines a cylindrical shape having said top edge defining a top opening and having said bottom edge defining a bottom opening in said cylindrical shape, said top opening being configured to have the users head extended therethrough such that said top edge surrounds the users neck having said bottom edge being positioned on the ground, said shroud having a cut extending through said inside surface and said outside surface wherein said cut is configured to have an object extended therethrough;

a panel being coupled to said shroud, said panel being aligned with said cut such that said cut and said panel define said pass-through, said panel being configured to inhibit the user from being visible through said cut, said panel having a peripheral edge, said peripheral edge having a first side, said peripheral edge being attached to said inside surface of said shroud, said first side being unattached from said shroud, said first side being spaced from said cut such that said panel defines said pass-through extending between said cut and said first side;

an elastic member being coupled to said shroud, said elastic member being aligned with and being coextensive with said top edge of said shroud wherein said elastic member is configured to bias said top edge to engage the users neck thereby retaining said shroud on the user;

a pocket being coupled to said shroud, said shroud being selectively gathered into said pocket for storage, said pocket being positioned on said outside surface of said shroud, said pocket having a top end, said top end being open such that said shroud is selectively pushed through said top end for storage, said pocket having an outwardly facing surface with respect to said shroud;

a flap being coupled to said outside surface of said shroud, said flap extending downwardly over said top end of said pocket to cover said top end;

a first string being coupled to said outside surface of said shroud, said first string being positioned in said pocket; and a second string being coupled said outwardly facing surface of said pocket, said first string being selectively tied to said second string when said shroud is positioned in said pocket thereby retaining said shroud in said pocket.

* * * * *